United States Patent [19]

Simpson

[11] 4,132,501

[45] Jan. 2, 1979

[54] TELEPHONE BOOK HANGER

[76] Inventor: Paul R. Simpson, 1718 Willow Creek Rd., Prescott, Ariz. 86301

[21] Appl. No.: 848,681

[22] Filed: Nov. 4, 1977

[51] Int. Cl.[2] ..... B42D 17/00

[52] U.S. Cl. ..... 281/15 A; 24/154

[58] Field of Search ..... 281/15 A, 15 B, 50; 24/154, 230.5 R, 230.5 AD, 230.5 TP

[56] References Cited

U.S. PATENT DOCUMENTS

| | | | |
|---|---|---|---|
| 439,643 | 11/1890 | Fine | 281/15 A |
| 1,133,655 | 3/1915 | Morgan | 281/15 A |
| 1,475,451 | 11/1923 | Schwartz | 281/15 A |
| 3,826,582 | 7/1974 | Podosek | 281/15 A X |

*Primary Examiner*—Frank T. Yost

*Attorney, Agent, or Firm*—John J. Byrne

[57] ABSTRACT

Disclosed is a hanger for a telephone book or the like. The hanger comprises an elongated body, a pointed ear projecting from the elongated body transversely to its length, a holding dog carried by the elongated body and defining therewith a recess parallel to the length of the elongated body on the same side of the elongated body as the pointed ear, and means for suspending the elongated body. Preferably the hanger is fashioned as an integral unit from flat stock.

5 Claims, 6 Drawing Figures

TELEPHONE BOOK HANGER

FIELD OF THE INVENTION

This invention relates to a hanger for a telephone book or the like. In particular, it relates to one which is advantageously fashioned as an integral unit from flat stock.

BACKGROUND OF THE INVENTION

It is often desirable to be able to suspend a telephone book or the like from a peg or other elevated location so that the book is conveniently and immediately accessible. Various devices for accomplishing this result are known and are shown, for example, in U.S. Pat. Nos. 1,175,655, 1,475,451, 2,007,612, and 3,826,582. All of these device, so far as is known, however, suffer from either or both of two basic drawbacks: either they comprise multiple parts and are expensive to manufacture or they significantly damage and weaken the spine of the book hanging from them.

OBJECTS OF THE INVENTION

It is, therefore, a general object of the invention to provide a hanger for telephone books or the like which will obviate or minimize problems of the type previously described.

It is a particular object of the invention to provide such a hanger which comprises only a single part (or, at most, two parts) and which is inexpensive to manufacture.

It is a further object of the invention to provide such a hanger which does not significantly damage or weaken the spine of the book hanging from it.

It is another object of the invention to provide such a hanger which can be fashioned as an integral unit from flat stock.

Other objects and advantages of the present invention will become apparent from the following detailed description of a preferred embodiment thereof taken in conjunction with the accompanying drawings.

DETAILED DESCRIPTION OF THE PRESENTLY PREFERRED EMBODIMENT

Figure 1:
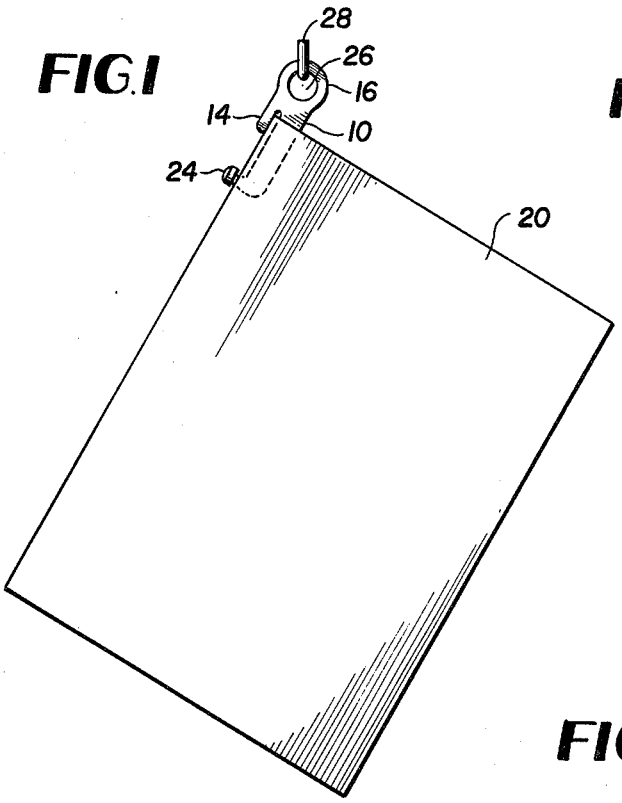
FIG. 1 is a plan view of a first embodiment of the present invention is side view, showing it in use.
Figure 2:
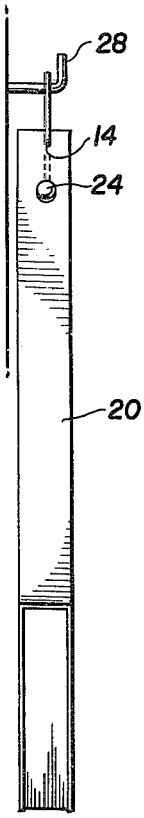
FIG. 2 is a side view of the embodiment of FIG. 1, again showing the hanger in use.
Figure 3:
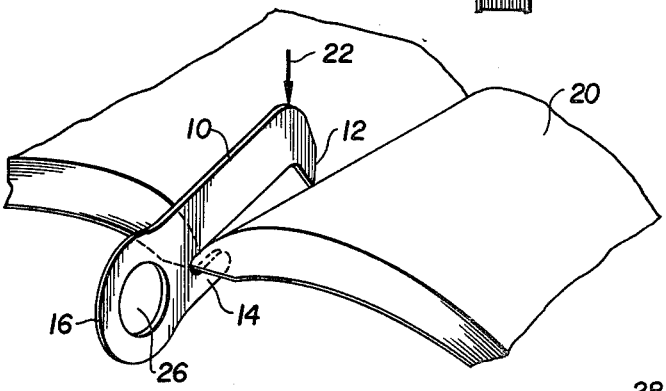
FIG. 3 is perspective view, showing a book being attached to the embodiment of FIG. 1.
Figure 4:
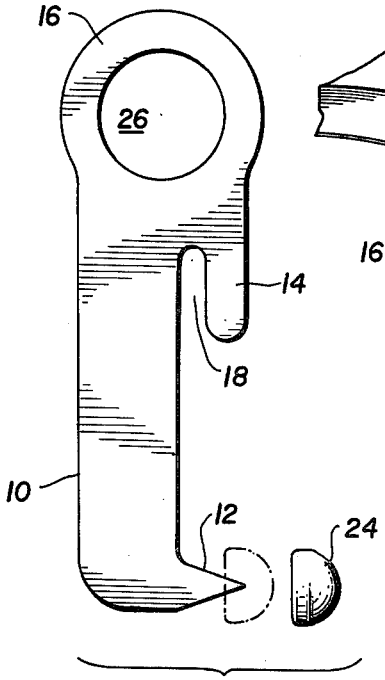
FIG. 4 is a plan view of the embodiment of FIG. 1, showing how an instant rivet can be attached to its point.

The hanger illustrated in FIGS. 1–4 comprises an elongated body 10, a pointed ear 12, a holding dog 14, and means 16 for suspending the elongated body 10. The pointed ear 12 projects from the elongated body 10 transversely to its length, and the holding dog 14 is carried by the elongated body 10 and defines therewith a recess 18 parallel to the length of the elongated body 10 on the same side of the elongated body 10 as the pointed ear 12. The recess 18 is open towards the pointed ear 12 and spaced therefrom so that, as shown in FIG. 3, the spine of an open book 20 can be slipped into the recess 18, after which the pointed ear 12 can be forced through the spine of the book 20 in the direction of the arrow 22 to firmly attach the book to the hanger. Although not essential to use of the invention in most environments, as instant rivet 24 is preferably pressed on to the pointed ear 12 after it has emerged from the spine of the book 20 to blunt the sharp point of the ear. (As such instant rivets are readily commercially available and form no part of the present invention, they are not described in detail herein.)

Figure 6:
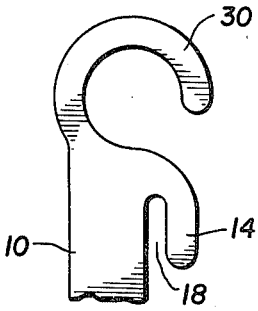
FIG. 6 is a fragmentary plan view of a third embodiment of the present invention.
Figure 5:
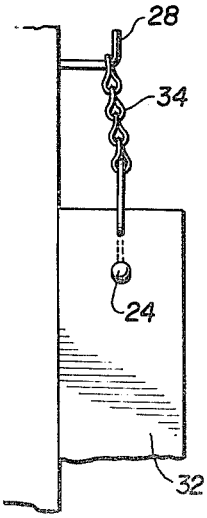
FIG. 5 is a side view similar to FIG. 2, but showing a modification of the device which is particularly suitable for use with relatively thick books.

The means 16 for suspending the elongated body 10 can take on various forms. As illustrated in FIGS. 1–4, it may simply be an aperture 26 in the hanger by means of which the hanger (and thus the book 20) can be suspended from a hook 28. Alternatively, as shown in FIG. 6, the means 16 may be a hook 30 carried by the elongated body 10. Furthermore, especially when it is desired to use the hanger with a particularly thick book 32, it may be desirable to provide a chain 34 as shown in FIG. 5 to connect the means 16 with the hook 28 or similar device. However, I have found that, on books over one inch thick, if, instead of opening the book half way to insert the hanger, the user opens the book to within a half inch or less of the back the chain 34 is not necessary.

Preferably the hanger is fashioned as an integral unit from flat stock, which may be metal, plastic, or the like. Although the specific shape of the hanger may vary within the scope of the appended claims, the elongated body 10 is preferably rectangular in shape, the pointed ear 12 is preferably located at one end of the elongated body 10, and the holding dog 14 is preferably located at the other end of the elongated body 10.

CAVEAT

While the present invention has been illustrated by a detailed description of several preferred embodiments thereof, it will be obvious to those skilled in the art that various changes in form and detail can be made therein without departing from the true scope of the invention. For that reason, the invention must be measured by the claims appended hereto and not by the foregoing preferred embodiments.

What is claimed is:

1. A hanger for a telephone book or the like, said hanger comprising:

(a) an elongated body;

(b) a pointed ear projecting from said elongated body transversely to its length;

(c) a holding dog carried by said elongated body and defining therewith a recess parallel to the length of said elongated body on the same side of said elongated body as said pointed ear, said recess being open towards said pointed ear and spaced therefrom; and (d) means for suspending said elongated body.

2. A hanger as recited in claim 1 wherein said means comprises an aperture in said hanger.

3. A hanger as recited in claim 1 wherein said means comprises a hook carried by said elongated body.

4. A hanger as recited in claim 1 wherein said hanger is an integral unit fashioned from flat stock.

5. A hanger as recited in claim 4 wherein said elongated body is rectangular in shape, said pointed ear is located at one end of said elongated body, and said holding dog is located at the other end of said elongated body.

* * * * *